US008182082B2

(12) United States Patent
Chan et al.

(10) Patent No.: US 8,182,082 B2
(45) Date of Patent: May 22, 2012

(54) PRINTER ACCESSORY MODULE FOR HIGH CAPACITY PRINTING

(75) Inventors: Kok Weng Chan, Singapore (SG); Tong Nam Samuel Low, Singapore (SG); Chiok Liang Tay, Singapore (SG); Chuan Sing Beh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 456 days.

(21) Appl. No.: 12/398,991

(22) Filed: Mar. 5, 2009

(65) Prior Publication Data

US 2010/0225726 A1 Sep. 9, 2010

(51) Int. Cl.
*B41J 2/01* (2006.01)

(52) U.S. Cl. ..... 347/105; 347/104

(58) Field of Classification Search ..... 347/104, 347/105

See application file for complete search history.

(56) References Cited

U.S. PATENT DOCUMENTS

| | | | | |
|---|---|---|---|---|
| 5,191,382 | A * | 3/1993 | Okamura et al. | 399/107 |
| 6,273,560 | B1 | 8/2001 | Keefe et al. | |
| 6,511,173 | B2 * | 1/2003 | Suzuki et al. | 347/106 |
| 6,577,818 | B2 * | 6/2003 | Hirano | 396/30 |
| 6,655,776 | B2 * | 12/2003 | Murray | 347/19 |
| 6,679,592 | B2 | 1/2004 | Casserino et al. | |
| 7,976,151 | B2 * | 7/2011 | Tanabe | 347/104 |
| 2001/0033314 | A1 * | 10/2001 | Yoshino et al. | 347/86 |
| 2003/0035041 | A1 * | 2/2003 | Yoshino et al. | 347/108 |

* cited by examiner

*Primary Examiner* — Charlie Peng

(57) ABSTRACT

A printer accessory module for coupling to a printer to increase its printing capacity. The printer accessory module includes an auxiliary media module for storing and supplying printer media; and an auxiliary ink supply station for storing and supplying ink to the printer. The auxiliary ink supply station is connected to the printer by a ink delivery conduit system.

19 Claims, 2 Drawing Sheets

PRINTER ACCESSORY MODULE FOR HIGH CAPACITY PRINTING

BACKGROUND

The present disclosure relates generally to printer accessory modules and more particularly to a high volume accessory module for a printer.

The printing capacity of a printer is often correlated to the capacity of the printer's input print media tray. Some printers have input media trays capable of storing and handling in excess of several hundred pages of print media. During high volume printing, the operation of printing may be interrupted when print media is depleted and has to be manually topped up in the input print media tray. As such, accessory trays have been developed to couple to such printers. These accessory trays have additional input print media trays which increase the print media capacity of the printer.

The printing capacity of a printer may however also be correlated to the volume of ink immediately accessible to the printer during operation. Increasing the availability of ink to the printer also results in the printer being able to at print at higher capacities without being interrupted.

DETAILED DESCRIPTION

Figure 1:
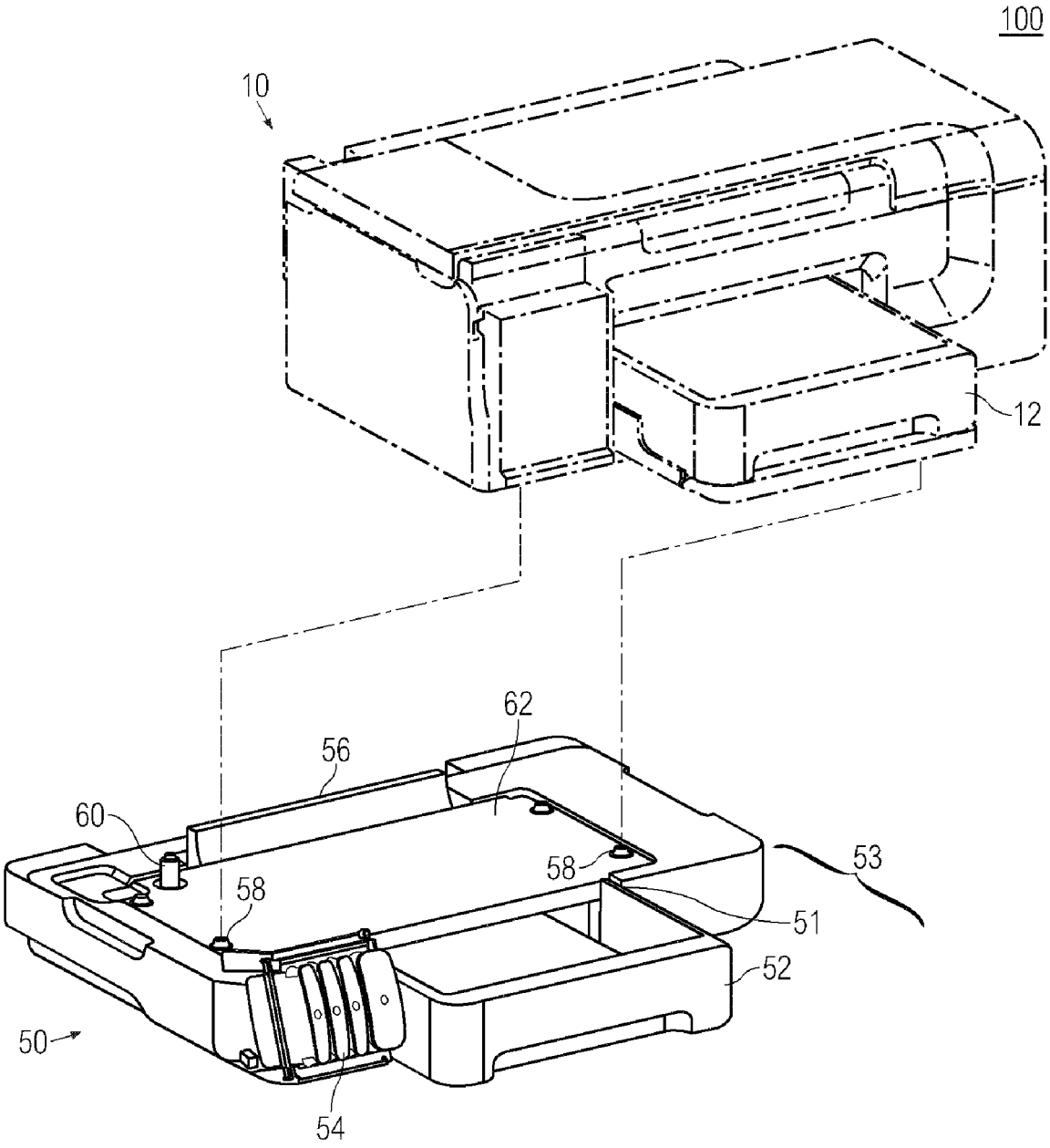
FIG. 1 illustrates an auxiliary module for a printer in accordance with the present embodiment.
Figure 2:
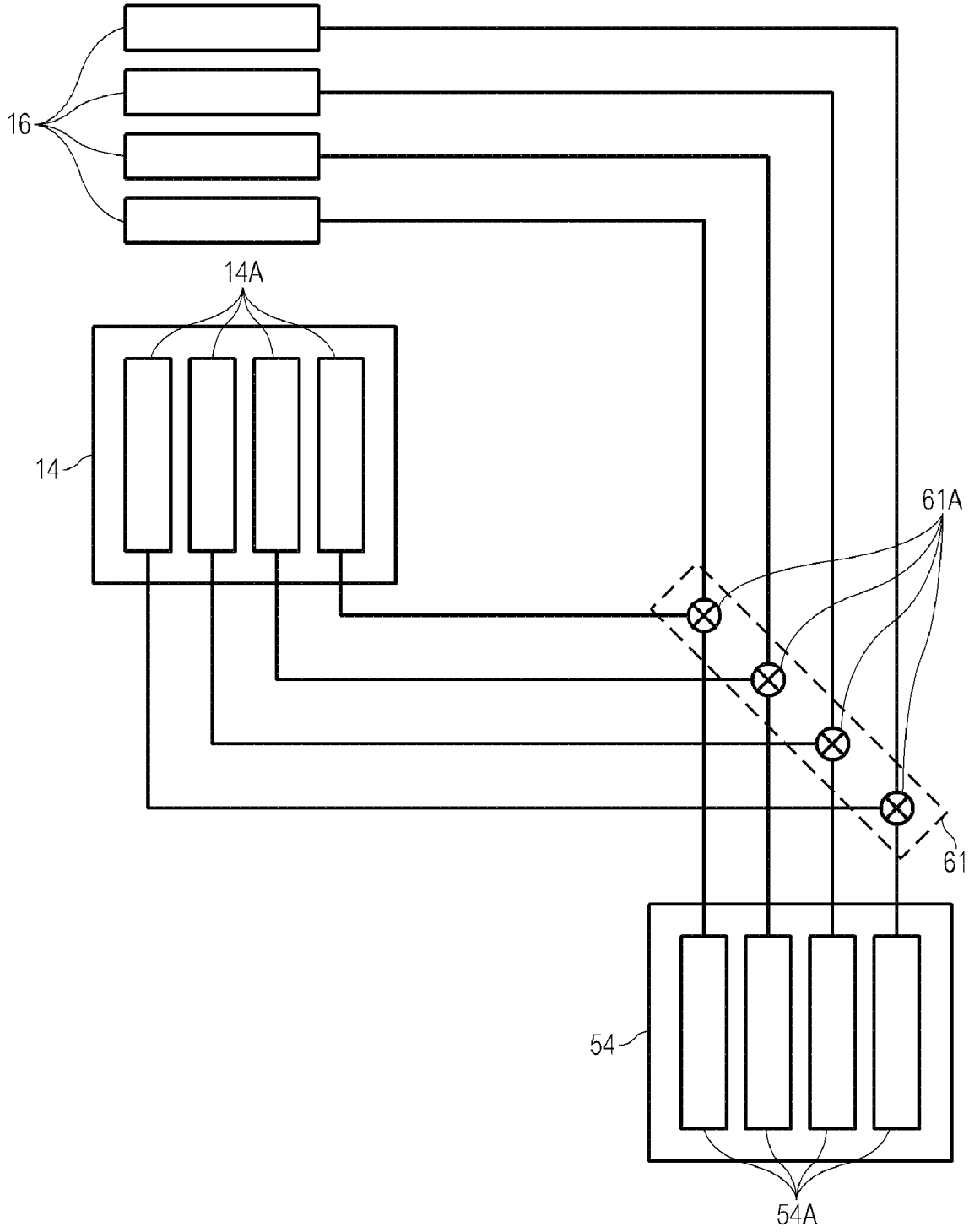
FIG. 2 shows a simplified block diagram of FIG. 1

FIG. 1 and FIG. 2 show a printing system 100 incorporating the present embodiment. The system 100 comprises a printer 10 and an auxiliary module 50. The printer 10 and the auxiliary module 50 are both adapted to interconnect to each other and to operate in an interconnected manner. The printer 10 may be in general a inkjet type printer which comprises multiple components which are not described in detail in the present disclosure. A person skilled in the art would be familiar with the operational characteristics and technical details of such a printer 10.

The printer 10 in the present embodiment comprises at least a primary ink supply station 14. Such a primary ink supply station 14 may be an off-axis ink supply or may be a direct mounted ink supply adjacent to one or more print heads 16 of the printer 10. The ink supply station 14 comprises at least one or a plurality of ink cartridges 14A mounted into the ink supply station 14. The ink in the ink cartridges 14A is then drawn from the ink supply station 14 via fluid couplings, tubes and conduits to the print heads 16. The ink may be pressurized by mechanical or an electromechanical means (not shown) such as pumps or may be drawn by gravity in delivering the ink to the print heads 16.

The auxiliary module 50 comprises an auxiliary media module 53 and an auxiliary ink supply station 54. The auxiliary module 50 has a housing 62 having an upper surface for supporting the printer 10. When in operation, the printer 10 may be mounted on the auxiliary module 50 and is connected or coupled together to the printer 10. The housing 62 further comprises a receptacle 51 for receiving an auxiliary media tray 52 moveable into and out of the receptacle 51. The receptacle 51 and auxiliary media tray 52 in combination forms the auxiliary media module 53. Additional print media such as paper or transparencies may be stored in the auxiliary media tray 52 of the auxiliary media module 53 and supplied to the printer 10 for printing. A media handling means 56 further forms part of the auxiliary module 50 and serves to transport individual media from the auxiliary media module 53 to a media feed system of the printer 10. The printer 10 would also be adapted to couple with the auxiliary module 50 and also to operate with and receive media from the media handling means 56 of the auxiliary module 50.

The auxiliary ink supply station 54 comprises at least one or a plurality of ink cartridges 54A mounted into the auxiliary ink supply station 54. The auxiliary ink supply station 54 may be located in a convenient location on the housing 62 permitting easy user access to the ink cartridges 54A. An auxiliary ink conduit system located within the housing 62 is adapted to provide fluid communication between the auxiliary ink supply station 54 and the plurality of print heads 16 and serves to deliver ink from the cartridges 54A of the auxiliary ink supply station 54 to the print heads 16 of the printer 10. As the auxiliary ink supply station 54 is sited relatively remote from the print heads 16, a mechanical or an electromechanical means such as a pump may be incorporated into the ink supply station 54 to provide pressure in the delivery of the ink to the print heads 16. Alternatively, such a pressurizing means may be incorporated into the cartridges 54A to provide the pressure for delivery of ink to the print heads 16. An example of such a pressurizing means would be a diaphragm pump incorporated into the ink cartridges.

The housing of the auxiliary module 50 further comprises at least one guide pin 58, for guiding the printer 10 to be seated on the auxiliary module 50 correctly. This ensures that the auxiliary module 50 couple with the printer 10 in a manner which permits the auxiliary media module 53 to properly transport and feed media to the printer 10.

FIG. 2 shows a simplified block diagram of the printing system of FIG. 1. A multi-way valve assembly 61 fluidically links the primary ink supply station 14, the auxiliary ink supply station 54 and the print heads 16 of the printer 10. The multi-way valve assembly 61 further comprises a plurality of multi-way valves 61A, each of which links an individual conduit from each of the ink cartridges 54A of the auxiliary ink supply station 54, to a corresponding ink cartridge 14A of the primary ink supply station 14 and to a corresponding print head 16.

At any one time, the multi-way valves 61A ensure that each of the print heads 16 is fluidically coupled to only one of a corresponding cartridge of either the primary ink supply station 14 or the auxiliary ink supply station 54, but not both. As such, ink will be drawn from one cartridge of either ink supply stations by each of the print heads 16. Actuation of one of the multi-way valves 61A will result in de-coupling of one of the corresponding cartridge from one of the ink supply stations and coupling to a corresponding cartridge of the other ink supply station.

The auxiliary module 50 further comprises a fluid link 60 which has a corresponding fluid link in the printer 10. The guide pin 58 further serves to ensure that the fluid link 60 of the auxiliary module 50 is properly coupled to corresponding fluid link of the printer 10. The fluid link 60 may further comprise of a plurality of conduits and couplings corresponding to the auxiliary ink conduit system.

The multi-way valve assembly 61 is generally located in the printer 10. The fluid link 60 found on the housing 62 of the auxiliary module 50 serves to connect the auxiliary ink supply station 54 to the multi-way valve assembly 61. When the auxiliary module 50 is not coupled to the printer 10, the multi-way valve assembly always fluidically couples the primary ink supply station 14 to the print heads 16.

Selection of cartridges from either the primary ink supply station 14 or the auxiliary ink supply station 54 may be based on whether priority is given to using up ink from one of the stations first then utilizing ink from the other station. Alternatively, it may be predetermined by a user setting on the multiway valves 61A or by predetermined instructions to the printer 10.

During operation, ink is usually first supplied by the cartridges 14A of the primary ink supply station 14 to the print heads 16. However, as printing occurs, ink from at least one of the ink cartridges 14A of the primary ink supply station 14 may become depleted.

When this occurs, the usual approach would be to interrupt the printing and to manually replace the depleted ink cartridge 14A with a new one.

In an example of an operational scenario in accordance with the present embodiment, during printing, one of the ink cartridges 14A of the primary ink supply station 14 is depleted. Detection of the empty cartridge 14A occurs in the printer 10 and the multiway valve 61A corresponding to the empty ink cartridge 14A of the multi-way valve assembly 61 is actuated in response to sensing the depletion of ink from that ink cartridge 14A. The valve 61A actuated fluidically disconnects the depleted ink cartridge 14A of the primary ink supply station 14 and fluidically connects the corresponding ink cartridge 54A of the auxiliary ink supply station 54 to the corresponding print head 16. Ink is now drawn from the ink cartridge 54A of the auxiliary ink supply station 54. This then allows uninterrupted printing when ink is depleted from the ink cartridges 14A of the primary ink supply station 14.

It is to be understood that the term "connect/connected" or "couple/coupled" are broadly defined herein to encompass a variety of divergent connection or coupling arrangements and assembly techniques. These arrangements and techniques include, but are not limited to (1) the direct connection or coupling between one component and another component with no intervening components therebetween; and (2) the connection or coupling of one component and another component with one or more components therebetween, provided that the one component being "connect to" or "coupled to" the other component is somehow operatively connected to the other component (notwithstanding the presence of one or more additional components therebetween).

Numerous variations and modifications will become apparent to those skilled in the art once the above disclosure is fully appreciated.

What is claimed is:

1. A printer accessory module for coupling to a printer to increase printing capacity, comprising:

an auxiliary media module for storing and supplying printer media to the printer, the auxiliary media module to supply the printer media in addition to other printer media that the printer itself is to store, such that the auxiliary media module provides supplemental printer media to the printer in that the printer is able to use, while the printer accessory module is coupled to the printer, both the printer media supplied by the auxiliary media module and the other printer media that the printer media itself is to store; and an auxiliary ink supply station for storing and supplying ink to the printer, the auxiliary ink supply station to supply the ink in addition to other ink that the printer itself is to store, such that the auxiliary ink supply station provides supplemental ink to the printer in that the printer is able to use, while the printer accessory module is coupled to the printer, both the ink supplied by the auxiliary ink supply station and the other ink that the printer itself is to store;

wherein the auxiliary ink supply station is fluidically coupled to an auxiliary ink conduit system for delivering ink from the auxiliary ink supply station to the printer;

wherein when the printer accessory module is coupled to the printer, the printer is able to use the ink supplied by the auxiliary ink supply station to print on the other printer media that the printer itself is to store, and the printer is able to use the use the other ink that the printer itself is to store on the printer media supplied by the auxiliary media module.

2. The accessory module of claim 1 wherein the auxiliary module further comprises a paper handling means for transporting individual media from the auxiliary media module to a media feed system of the printer.

3. The accessory module of claim 1 wherein the accessory module further comprises a housing having an upper surface for supporting the printer thereon.

4. The accessory module of claim 3 wherein the upper surface further comprises at least one guide pin for aligning the printer to couple with the accessory module.

5. The accessory module of claim 1 wherein the accessory module further comprises a fluid coupling link for coupling the auxiliary ink conduit system to the printer.

6. The accessory module of claim 5 wherein the fluid coupling link is adapted to couple to a valve assembly of the printer.

7. The accessory module of claim 6 wherein the valve assembly may be actuated to fluidically couple to at least one ink cartridge of either a primary ink supply station of the printer or to a corresponding ink cartridge of the auxiliary ink supply station.

8. The accessory module of claim 1 wherein the auxiliary ink supply station further provides the supplemental ink to the printer in that the other ink that the printer itself is to store and the ink supplied by the auxiliary ink supply station are of a same type, such that when the printer runs out of the other ink in printing a print job, the printer is to finish the print job using the ink supplied by the auxiliary ink supply station, and wherein the auxiliary media module further provides the supplemental printer media to the printer in that the other printer media that the printer itself is to store and the printer media supplied by the auxiliary media module are of a same type, such that when the printer runs out of the other printer media in printing the print job, the printer is to finish the print job using the printer media supplied by the auxiliary media module.

9. A method for increasing printer capacity, the method comprising:

providing a printer accessory module for coupling to the printer;

coupling the printer accessory module to the printer;

wherein the printer accessory module comprises an auxiliary media module for storing and supplying media to the printer, the auxiliary media module to supply the printer media in addition to other printer media that the printer itself is to store, such that the auxiliary media module provides supplemental printer media to the printer in that the printer is able to use, while the printer accessory module is coupled to the printer, both the printer media supplied by the auxiliary media module and the other printer media that the printer media itself is to store; and an auxiliary ink supply station for storing and supplying ink to the printer, the auxiliary ink supply station to supply the ink in addition to other ink that the printer itself is to store, such that the auxiliary ink supply station provides supplemental ink to the printer in that the printer is able to use, while the printer accessory module is coupled to the printer, both the ink supplied by the auxiliary ink supply station and the other ink that the printer itself is to store;

wherein when the printer accessory module is coupled to the printer, the printer is able to use the ink supplied by the auxiliary ink supply station to print on the other printer media that the printer itself is to store, and the printer is able to use the use the other ink that the printer itself is to store on the printer media supplied by the auxiliary media module.

10. The method of claim 9 wherein the auxiliary module further comprises a paper handling means for transporting individual media from the auxiliary media module to a media feed system of the printer.

11. The method of claim 9 wherein the accessory module further comprises a housing having an upper surface for supporting the printer thereon.

12. The method of claim 11 wherein the upper surface further comprises at least one guide pin for aligning the printer to couple with the accessory module.

13. The method of claim 9 wherein the accessory module further comprises a fluid coupling link for coupling the auxiliary ink conduit system to the printer.

14. The method of claim 9 wherein the auxiliary ink conduit system is coupled to a valve assembly of the printer.

15. The method of claim 14 wherein the valve assembly may be actuated to fluidically couple to at least one ink cartridge of either a primary ink supply station of the printer or to a corresponding ink cartridge of the auxiliary ink supply station.

16. A high capacity printing system, comprising:

a printer;

a printer accessory module, the printer accessory module comprising:

an auxiliary media module for storing and supplying printer media to the printer, the auxiliary media module to supply the printer media in addition to other printer media that the printer itself is to store, such that the auxiliary media module provides supplemental printer media to the printer in that the printer is able to use, while the printer accessory module is coupled to the printer, both the printer media supplied by the auxiliary media module and the other printer media that the printer media itself is to store; and an auxiliary ink supply station for storing and supplying ink to the printer, the auxiliary ink supply station to supply the ink in addition to other ink that the printer itself is to store, such that the auxiliary ink supply station provides supplemental ink to the printer in that the printer is able to use, while the printer accessory module is coupled to the printer, both the ink supplied by the auxiliary ink supply station and the other ink that the printer itself is to store;

wherein the auxiliary ink supply station is fluidically coupled to an auxiliary ink conduit system for delivering ink from the auxiliary ink supply station to the printer;

wherein when the printer accessory module is coupled to the printer, the printer is able to use the ink supplied by the auxiliary ink supply station to print on the other printer media that the printer itself is to store, and the printer is able to use the use the other ink that the printer itself is to store on the printer media supplied by the auxiliary media module.

17. The system of claim 16 wherein the accessory module further comprises a fluid coupling link for coupling the auxiliary ink conduit system to the printer.

18. The system of claim 16 wherein the auxiliary ink conduit system is coupled to a valve assembly of the printer.

19. The system of claim 18 wherein the valve assembly may be actuated to fluidically couple to at least one ink cartridge of either a primary ink supply station of the printer or to a corresponding ink cartridge of the auxiliary ink supply station.

* * * * *

UNITED STATES PATENT AND TRADEMARK OFFICE

CERTIFICATE OF CORRECTION

PATENT NO. : 8,182,082 B2
APPLICATION NO. : 12/398991
DATED : May 22, 2012
INVENTOR(S) : Kok Weng Chan et al.

It is certified that error appears in the above-identified patent and that said Letters Patent is hereby corrected as shown below:

In column 4, line 8, in Claim 1, after “use the” delete “use the”.

In column 5, line 9, in Claim 9, after “use the” delete “use the”.

In column 6, line 24, in Claim 16, after “use the” delete “use the”.

Signed and Sealed this
Twenty-fifth Day of December, 2012

David J. Kappos

David J. Kappos
*Director of the United States Patent and Trademark Office*